United States Patent [19]

Takeda

[11] Patent Number: 4,499,804

[45] Date of Patent: Feb. 19, 1985

[54] SAFETY DEVICE FOR A MEAT SLICER

[75] Inventor: Mutsumi Takeda, Fukushima, Japan

[73] Assignee: Hitachi Koki Haramachi Works, Ltd., Ibaraki, Japan

[21] Appl. No.: 475,654

[22] Filed: Mar. 15, 1983

[30] Foreign Application Priority Data

Mar. 16, 1982 [JP] Japan ..... 57-37597[U]

[51] Int. Cl.[3] ..... B26D 7/24

[52] U.S. Cl. ..... 83/399; 83/421; 83/467 R; 83/571; 83/707; 83/713; 241/37.5

[58] Field of Search ..... 83/268, 399, 421, 425, 83/571, 707, 717, 860, 467 R, 713; 241/36, 37.5

[56] References Cited

U.S. PATENT DOCUMENTS

| | | | |
|---|---|---|---|
| 2,108,306 | 2/1938 | Cooper | 83/707 |
| 2,358,223 | 9/1944 | Folk | 83/421 |
| 2,388,588 | 11/1945 | Wood | 83/421 |
| 2,558,766 | 7/1951 | Lundell | 83/421 |
| 2,926,711 | 3/1960 | Blumkin | 83/421 |
| 3,159,196 | 12/1964 | Engi | 83/399 |
| 3,704,736 | 12/1972 | Pratley | 83/860 |
| 4,246,821 | 1/1981 | Fuse | 83/571 |

*Primary Examiner*—Frank T. Yost
*Assistant Examiner*—Hien H. Phan
*Attorney, Agent, or Firm*—Sughrue, Mion, Zinn, Macpeak & Seas

[57] ABSTRACT

A safety device for a meat slicer includes a guide bar attached to a holding plate and a lock pin which is pressed by the guide bar. The lock pin and the guide bar are slidably fitted in a first blind hole formed in a guide block. A double latching mechanism, comprising a lock bar and an actuator, is engaged with the lock pin for controlling a switch which controls a driving circuit for the slicer, and the switch is actuated by the actuator.

6 Claims, 9 Drawing Figures

SAFETY DEVICE FOR A MEAT SLICER

BACKGROUND OF THE INVENTION

1. Field of the Invention

The present invention relates to a meat slicer including a circular blade which is rotatable in a fixed position and a meat box carrying a lump of meat within it. The meat box is reciprocally movable to and away from the circular blade so that, during each reciprocal motion of the meat box, a slice of meat, which is several millimeters thick and which is suitable for eating, may be cut from the lump of meat by the circular blade. More particularly, the invention is concerned with a safety device in such a meat slicer.

2. Description of the Prior Art

Referring to FIGS. 1-3 of the drawings, a conventional meat slicer includes a circular blade 2 rotatably supported at one end of a table 1, and a meat box 4 which is reciprocally movable by a crank or the like to and away from the circular blade 2 along rails 3. The meat box 4 is provided with a meat feed roller 5 adapted to feed out a lump of meat 6 during each reciprocal motion of the meat box 4 to enable the blade 3 to cut a slice of meat from the lump of meat 6. A holding plate 7 is secured by a guide block 8 to the table 1 adjacent to the circular blade 2. The holding plate 7 controls the slice thickness and functions as a cover for the circular blade 2. A screw 9 is rotatably secured to the holding plate 7. The screw is not removable axially, and it supports the holding plate 7 in the direction in which the meat is fed. The slicer also includes a base 10, a slice receiving plate 11 and a main switch 12.

The slicer includes a safety device which disables the rotation of the circular blade when the holding plate 7 has been removed from the guide block 8 for inspecting and repairing the slicer. The safety device comprises a safety bar 13 having one end projecting outward from the table 1. The safety bar 13 is maintained in abutment against the holding plate 7, and the other or inner end of the bar 13 is engaged with a switch L for controlling the driving circuit of the slicer. The safety bar 13 keeps the switch L in its ON position as long as the holding plate 7 is in position, as shown in FIG. 3. If the holding plate 7 is removed, the bar 13 projects further outward due to the force of a spring 14, and the inner end of the bar 13 is disengaged from the switch L so that the switch L may be turned off. The safety device, however, fails to work properly if someone or something, such as a meat tray, is brought into contact with the outer end of the bar 13. In addition, if meat dust or the like gathers and disables the smooth movement of the bar 13, the bar 13 is not able to move and be disengaged from the switch L, despite the presence of the spring 14. In both these situations, the safety device fails to operate which results in a dangerous situation. In this situation, the operator may inadvertently turn on the main switch without knowing that the switch L is in its ON position.

SUMMARY OF THE INVENTION

It is an object of the present invention to eliminate the drawbacks of the prior art, as pointed out above, and to provide a novel safety device for a meat slicer which ensures an improved degree of safety.

It is another object of the invention to provide a safety device for a meat slicer which is fully functional until it is disabled by the intentional action of the operator.

According to the invention, a guide bar is provided on a holding plate, and a lock pin which is pressed by the guide bar is slidably fitted into a blind hole formed in the guide block. The lock pin is urged by a spring against the guide block, and a double latching mechanism composed of a lock bar and an actuator is engaged with the lock pin. A switch for controlling the driving circuit for the slicer is actuated by the actuator.

DETAILED DESCRIPTION OF THE PREFERRED EMBODIMENTS

Figure 1:
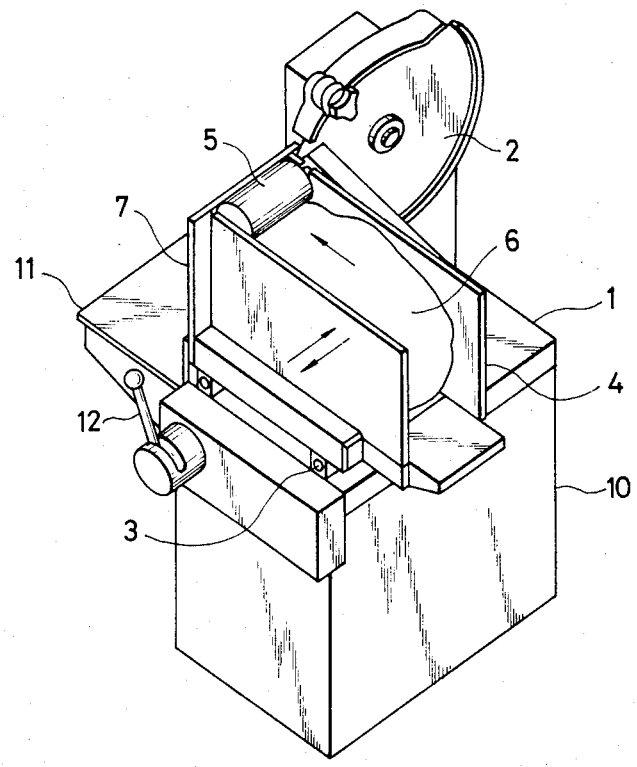
FIG. 1 PRIOR ART
FIG. 1 is a perspective view of a conventional meat slicer.
Figure 2:
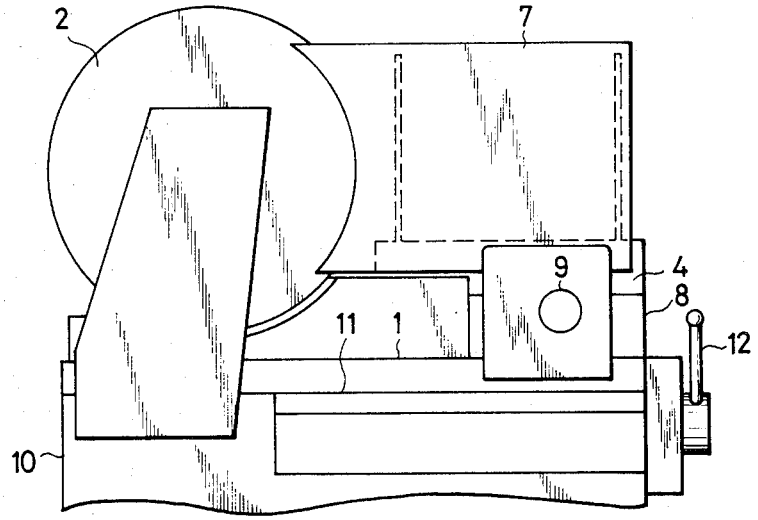
FIG. 2 PRIOR ART
FIG. 2 is a side elevational view of the slicer of FIG. 1.
Figure 3:
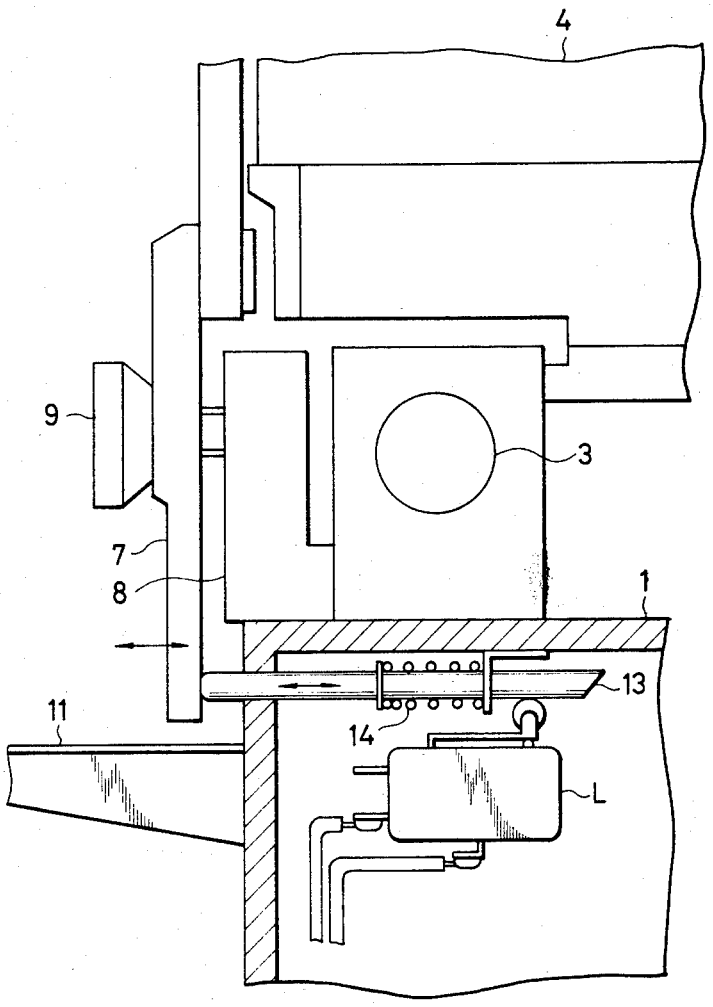
FIG. 3 PRIOR ART
FIG. 3 is a fragmentary, enlarged front elevational view, partly in section, of the slicer shown in FIG. 1.
Figure 4:
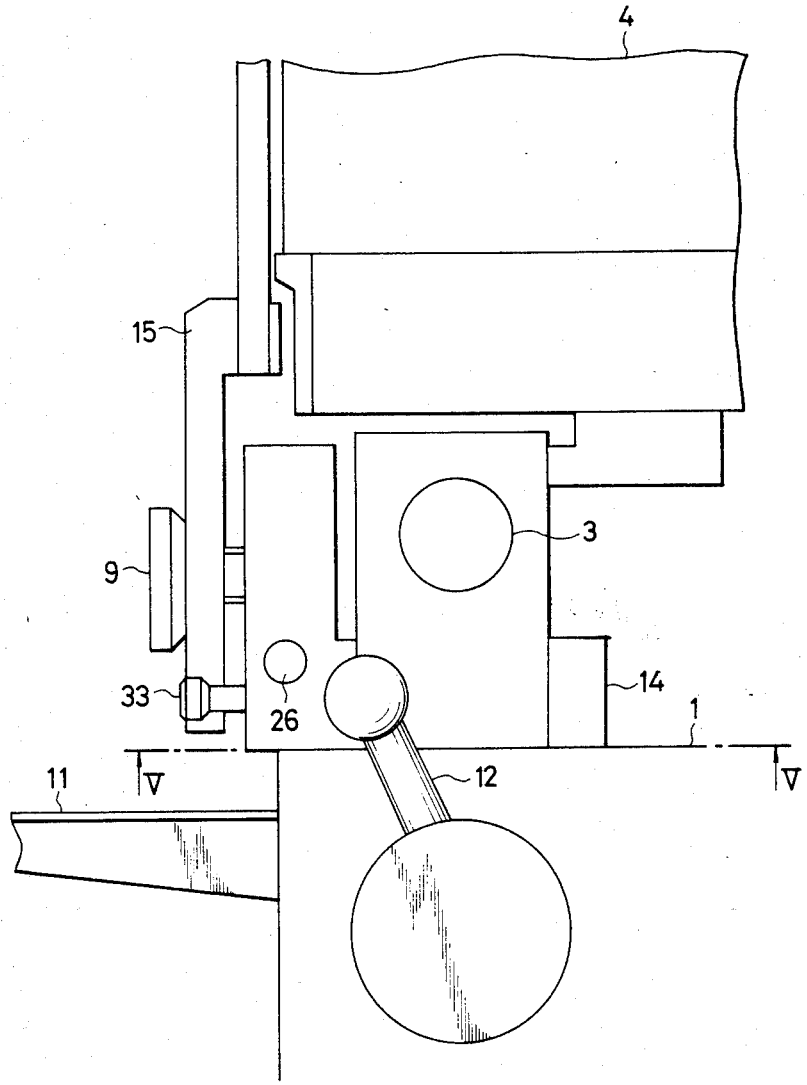
FIG. 4 is a fragmentary, front elevational view of a meat slicer embodying the present invention.

Referring to FIGS. 4-8 of the drawings, a meat slicer embodying the present invention includes an L-shaped guide block 14 secured to a table 1, the guide block 14 having an L-shaped vertical section. The guide block 14 has a blind hole 16 formed in a bottom portion, and the blind hole 16 has a longitudinal axis which is perpendicular to a holding plate 15. A lock pin 18 which is urged by a spring 17 is slidably fitted in the hole 16, and the lock pin 18 has a laterally extending pin 19. The guide block 14 has a slot 20 extending along the hole 16, and the pin 19 is engaged in the slot 20 so that the removal of the lock pin 18 from the guide block 14 is prevented. A guide bar 22 is secured to the holding plate 15 adjacent to its lower end and has a reduced diameter portion 21 received in the hole 16 of the guide block 14.

The guide block 14 is also provided with a second blind hole 23 which is perpendicular to the first blind hole 16 and connected therewith. A lock bar 26 is slidably fitted in the hole 23 and has an enlarged diameter portion 24 at its inner end which confronts the hole 16 and which is adapted to engage the reduced diameter portion 21 of the guide bar 22. The lock bar further has a reduced diameter portion 25 which is adjacent to its outer end and a reduced diameter portion 27 intermediate its ends. A screw 28 projects into the hole 23 and engages the portion 27 to restrict the movement of the lock bar 26 within a certain distance. The guide block 14 is further provided with a third blind hole 29 which extends parallel to the first blind hole 16 and which is partially connected with the second blind hole 23. The hole 29 has an intermediate portion exposed to a switch compartment 30 defined within the guide block 14 and accommodating a switch L within it. An actuator 33 is slidably received in the hole 29 and provided adjacent to its outer end with a reduced diameter portion 31 which is engageable with the reduced diameter portion 25 of the lock bar 26, while a reduced diameter portion 32 which is engageable with the switch L is provided adjacent to the inner end of the actuator 33. The actuator 33 is further provided with a stop pin 34 in its intermediate portion.

Figure 9:
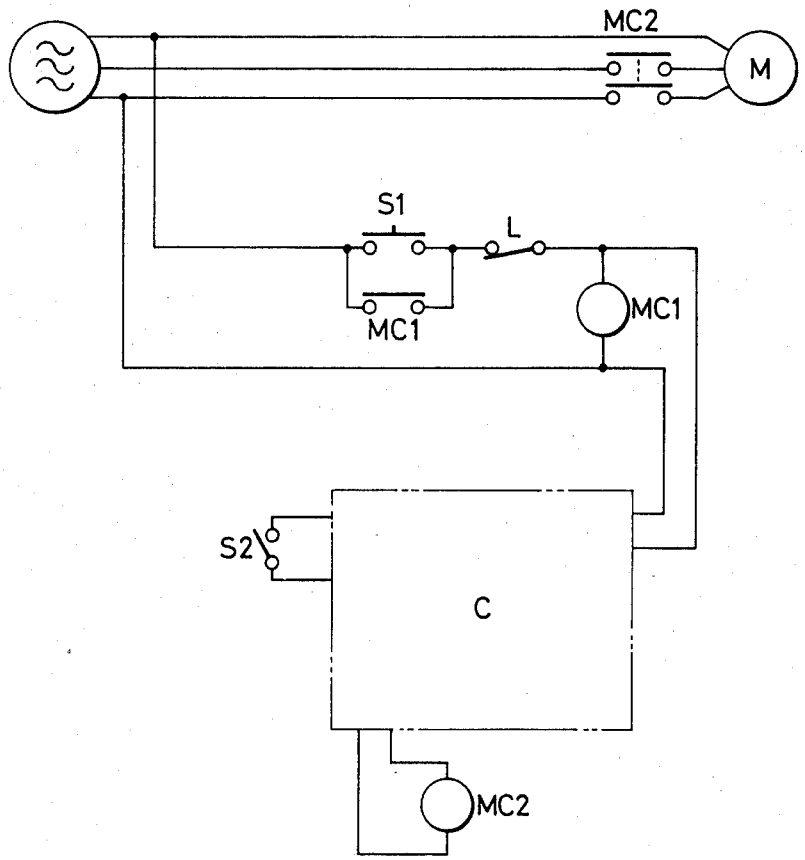
FIG. 9 illustrates an electric circuit for driving the slicer of the present invention.

Referring to FIG. 9, an electric circuit for the slicer includes a driving motor M connected to a power source through the contacts of a relay MC2, and a controller C is connected to the power source through a switch S1 and the switch L disposed in series. The switch S1 and a relay MC1 define a self-holding circuit. A switch S2 and the coil of the relay MC2 are connected to the controller C. Thus, the switch L controls the power connection to the controller C.

Figure 5:
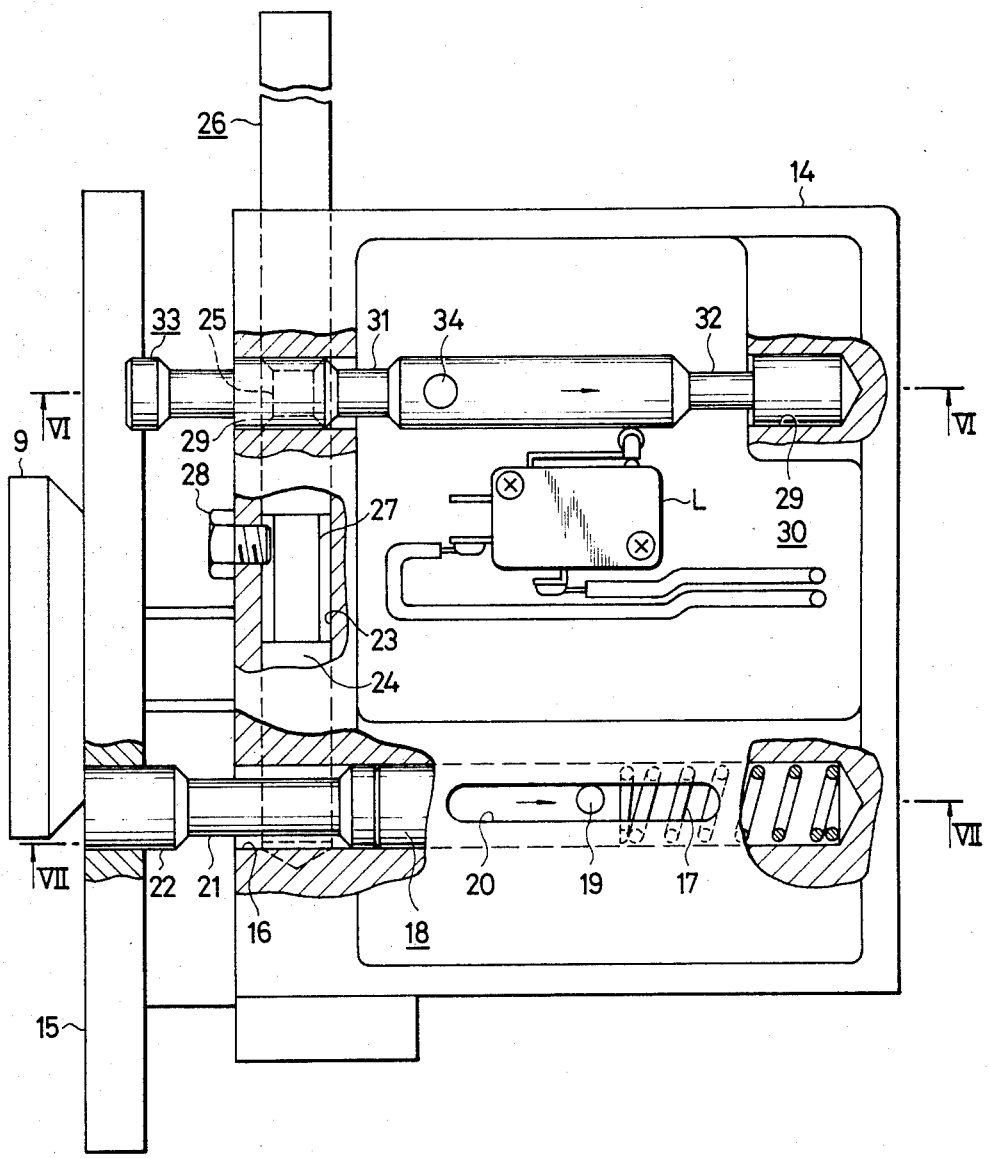
FIG. 5 is a sectional view taken along line V-V of FIG. 4.
Figure 6:
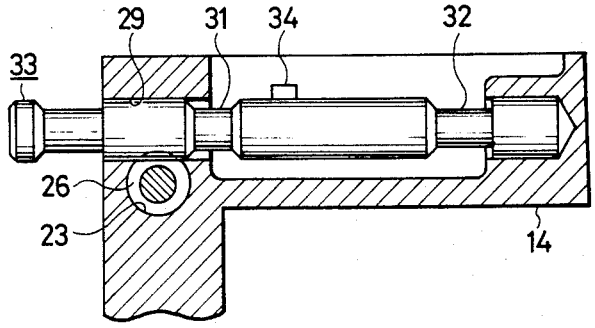
FIGS. 6 and 7 are sectional views taken along the lines VI—VI and VII—VII, respectively, of FIG. 5.
Figure 7:
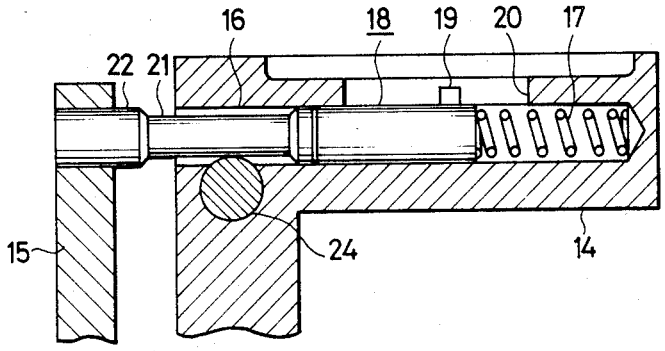

When the holding plate 15 is in position on the slicer, the guide bar 22 of the holding plate 15 projects into the blind hole 16, as shown in FIG. 5. The lock pin 18 is retracted toward the bottom of the hole 16 by compressing the spring 17. If the lock bar 26 is inserted in the blind hole 23, its enlarged diameter inner end portion 24 is engaged with the reduced diameter portion 21 of the guide bar 22 to fix the holding plate 15 to the guide block 14. If the actuator 33 is inserted into the blind hole 29, and if the switch L is brought into engagement with the enlarged diameter portion of the actuator 33 after its engagement with the reduced diameter portion 32, the switch L is turned on to make the slicer ready for operation. The holding plate 15 is movable to the extent which the reduced diameter portion 21 of the guide bar 22 permits so that the thickness of the slice of meat may be adjusted by a screw 9.

Figure 8:
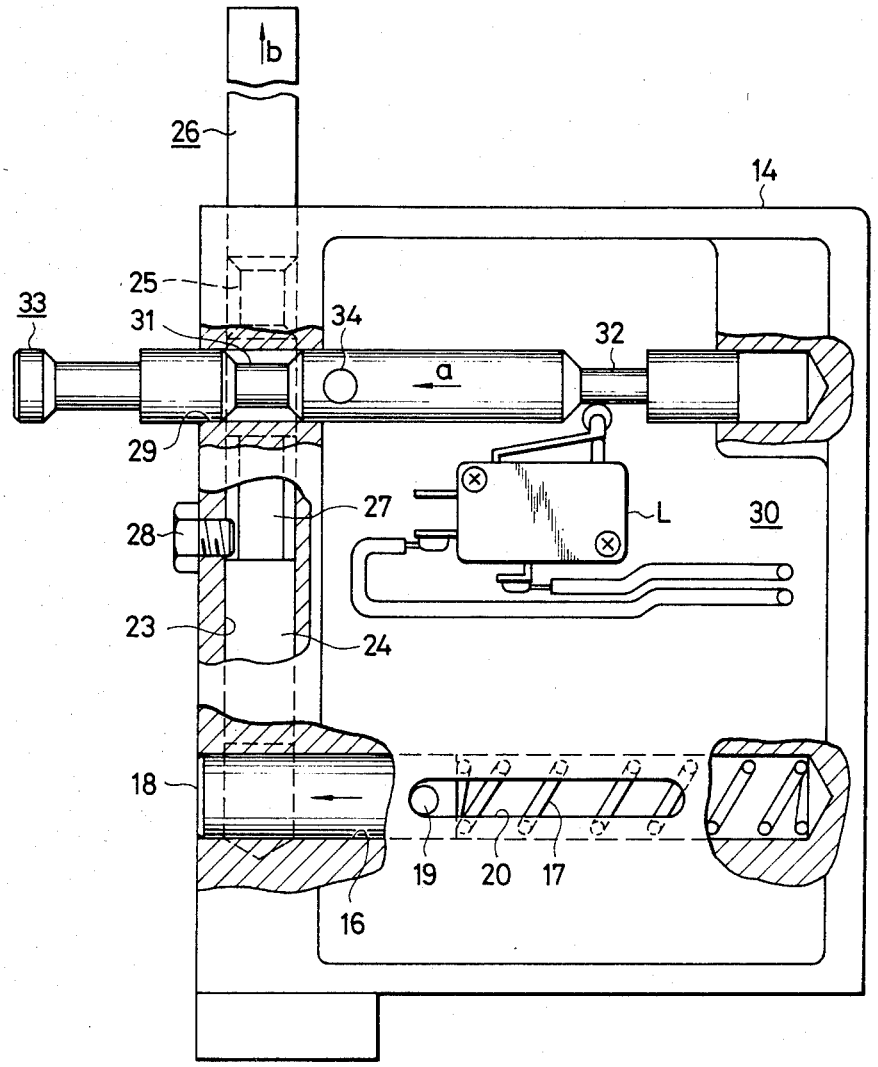
FIG. 8 is a view similar to FIG. 5 but which shows the slicer from which the holding plate has been removed.

When it is necessary to remove the holding plate 15, the actuator 33 is first pulled out in the direction of an arrow a, as shown in FIG. 8. The switch L is thus turned off, and, as the reduced diameter portion 31 is aligned with the blind hole 23, the lock bar 26 can be pulled out in the direction of an arrow b in FIG. 8. If the screw 9 is then loosened, the guide bar 22 is pushed out by the spring 17 and the lock pin 18 so that the holding plate 15 may be removed from the guide block 14. The lock pin 18 prevents the insertion of the lock bar 26 in the blind hole 23. It is, therefore, impossible to insert the actuator 33 into the blind hole 29 to turn on the switch L.

As is obvious from the foregoing description, the switch in the slicer of the invention can never be turned on inadvertently by an unintentional action of the operator, and it can never be turned on unless the holding plate is connected to the guide block. Since only the intentional use of the double latching mechanism, which is composed of the lock bar and the actuator, enables the switch to be turned on or off, it is possible to reliably prevent the occurrence of any situation in which the safety device may fail due to the gathering of meat dust or the like.

I claim:

1. In a meat slicer including a circular blade supported rotatably at one end of a table, a meat box for carrying a lump of meat therein, and reciprocally movable to and away from said blade along rails provided on said table, and a holding plate supported removably on said table adjacent to said blade, and movably in the direction in which said meat box is reciprocally movable, a safety device, comprising:

a lock pin slidably fitted in a first blind hole formed horizontally in said table;

a spring disposed in said first blind hole between a bottom of said first blind hole and said lock pin for urging said lock pin toward an open end of said first blind hole so that said lock pin may extend flush with said open end;

a guide bar secured to said holding plate and having a portion received in said first blind hole;

said table having a second blind hole which is connected with said first blind hole;

a lock bar slidably received in said second hole and having an engaging portion at its inner end which confronts said first blind hole for selectively engaging said portion of said guide bar, said lock bar further having a first reducing diameter portion adjacent to its outer end;

an actuator slidably received in a third blind hole which is connected to said second hole, said actuator having a reduced diameter portion engageable with said first reduced diameter portion of said lock bar, and a first switch L engaged with said actuator and controlled thereby for controlling a driving circuit for said slicer.

2. The safety device as claimed in claim 1, wherein said first blind hole has a longitudinal axis which is substantially perpendicular to said holding plate, said second blind hole being substantially perpendicular to said first blind hole, and said third blind hole being substantially perpendicular to said second blind hole.

3. The safety device as claimed in claim 1, wherein said lock pin has a laterally projecting pin portion engaged in a slot extending along said first blind hole so that said lock pin is prevented from being removed from said guide block, said lock bar having a second reduced diameter portion intermediate said inner and outer ends thereof, and further comprising a screw projecting into said second blind hole for engaging said second reduced diameter portion of said lock bar for limiting movement of said lock bar.

4. The safety device as claimed in claim 1, further comprising a switch compartment which accommodates said switch and which is exposed to said third blind hole, said switch being selectively engageable with a second reduced diameter portion of said actuator and being controlled by said actuator.

5. The safety device as claimed in claim 4, further comprising a lock pin connected to an internal portion of said actuator.

6. The safety device as claimed in claim 1, wherein said driving circuit comprises a driving motor connected to a power source through contacts of a first relay, a controller connected to said power source through said first switch and a second switch disposed in series, said second switch and said first relay defining a self-holding circuit, and a third switch and a coil of said first relay being connected to said controller.

* * * * *